US010502415B2

(12) United States Patent
Kang et al.

(10) Patent No.: US 10,502,415 B2
(45) Date of Patent: Dec. 10, 2019

(54) SYSTEM AND METHOD FOR REDUCING EMISSIONS FROM A BOILER

(71) Applicant: GENERAL ELECTRIC TECHNOLOGY GMBH, Baden (CH)

(72) Inventors: Shin Gyoo Kang, Simsbury, CT (US); Armand Alfred Levasseur, Windsor Locks, CT (US); Robert A. Schrecengost, Avon, CT (US)

(73) Assignee: GENERAL ELECTRIC TECHNOLOGY GMBH (CH)

( * ) Notice: Subject to any disclaimer, the term of this patent is extended or adjusted under 35 U.S.C. 154(b) by 482 days.

(21) Appl. No.: 14/876,926

(22) Filed: Oct. 7, 2015

(65) Prior Publication Data

US 2016/0069562 A1 Mar. 10, 2016

Related U.S. Application Data

(63) Continuation of application No. 13/331,234, filed on Dec. 20, 2011, now abandoned.

(60) Provisional application No. 61/426,616, filed on Dec. 23, 2010.

(51) Int. Cl.
*F23D 11/42* (2006.01)
*F23D 1/00* (2006.01)

(52) U.S. Cl.
CPC ..... *F23D 1/005* (2013.01); *F23D 1/00* (2013.01); *F23C 2900/03005* (2013.01); *F23D 2207/00* (2013.01); *F23D 2208/00* (2013.01); *F23D 2900/00015* (2013.01)

(58) Field of Classification Search
CPC .. F23D 1/00; F23D 2201/10; F23D 2201/101; F23D 2201/20; F23C 2201/101; F23C 5/32; F23C 5/08; F23C 6/047; F23C 6/04; F23C 2900/03005; F23Q 9/045
See application file for complete search history.

(56) References Cited

U.S. PATENT DOCUMENTS

| | | | |
|---|---|---|---|
| 1,105,804 | A | 8/1914 | Lawton |
| 3,816,062 | A | 6/1974 | Bouvier |
| 4,150,631 | A | 4/1979 | Frey et al. |
| 4,221,174 | A | 9/1980 | Smith et al. |

(Continued)

FOREIGN PATENT DOCUMENTS

| | | | |
|---|---|---|---|
| CN | 200989583 | A | 12/2007 |
| CN | 101290117 | A | 10/2008 |

(Continued)

OTHER PUBLICATIONS

WO 2009111912 A1—English translation.*

(Continued)

*Primary Examiner* — Jorge A Pereiro
(74) *Attorney, Agent, or Firm* — Grogan, Tuccillo & Vanderleeden, LLP

(57) ABSTRACT

A system and method for reducing emissions from a boiler. A boiler generally has a combustion area. The system further includes a fuel pipe for delivering fuel. The system further includes a conduit. A bore extends through the conduit. The bore of the conduit is in fluid communication with the fuel pipe and the combustion area of the boiler. A pre-ignition source is positioned in the conduit. The pre-ignition source operates to pre-ignite at least a portion of the fuel flowing through the conduit.

19 Claims, 3 Drawing Sheets

(56) References Cited

U.S. PATENT DOCUMENTS

| | | | | |
|---|---|---|---|---|
| 4,241,673 | A | 12/1980 | Smith et al. | |
| 4,466,363 | A | 8/1984 | Leikert et al. | |
| 4,654,001 | A | 3/1987 | LaRue | |
| 4,660,478 | A | 4/1987 | Sheppard et al. | |
| 5,303,678 | A | 4/1994 | Haumann et al. | |
| 5,315,939 | A * | 5/1994 | Rini | F23C 5/32 110/232 |
| 5,697,306 | A | 12/1997 | LaRue et al. | |
| 6,699,029 | B2 | 3/2004 | Kobayashi et al. | |
| 6,699,031 | B2 | 3/2004 | Kobayashi et al. | |
| 7,281,478 | B2 * | 10/2007 | Wang | F23D 1/00 110/347 |
| 7,739,967 | B2 | 6/2010 | Briggs, Jr. et al. | |
| 8,555,795 | B2 | 10/2013 | Cheng et al. | |
| 2004/0114300 | A1 | 6/2004 | Wang et al. | |
| 2009/0038518 | A1 | 2/2009 | Liu et al. | |
| 2011/0033807 | A1 | 2/2011 | Wang et al. | |
| 2012/0006238 | A1 | 1/2012 | Cheng et al. | |

FOREIGN PATENT DOCUMENTS

| | | | | |
|---|---|---|---|---|
| CN | 101294705 | A | 10/2008 | |
| CN | 101865459 | A | 10/2010 | |
| EP | 2019263 | A1 | 1/2009 | |
| EP | 2 253 884 | A1 | 11/2010 | |
| JP | 6237607 | A | 2/1987 | |
| JP | H10213309 | A | 8/1998 | |
| WO | WO 2009111912 | A1 * | 9/2009 | F23C 5/08 |

OTHER PUBLICATIONS

Unofficial translation of Japanese Office Action issued in connection with corresponding JP Application No. 2013-546327 dated Mar. 2, 2015.

European Search Report and Opinion issued in connection with corresponding European Application No. 11810949.5 dated Jan. 23, 2017.

US Dept. of Energy/National Energy Technology Laborator, "Evaluation of Plasma Ignition Technology for use in United States Coal Fired Power Plants", Jun. 2008.

Lockert, Branning, Niu, "Plasma Based Technology for Oil-free Ignition and Stabilization of Pulverized Coal Burners", presented Tues. Aug. 10, 2010 at the Coal-Gen 20-Ten Conference, Aug. 10-12, 2010 at the David L. Lawrence Convention Center, Pittsburgh, PA.

Combustion of Coal, Using Thermo Utilities, MS Excel Addins. 1999.

* cited by examiner

SYSTEM AND METHOD FOR REDUCING EMISSIONS FROM A BOILER

CROSS-REFERENCE TO RELATED APPLICATIONS

The present application claims priority to and is a continuation patent application of U.S. Ser. No. 13/331,234 filed Dec. 20, 2011, which claims the benefit under 35 U.S.C. § 119 (e) of Provisional Patent Application No. 61/426,616 filed Dec. 23, 2010, the disclosure of which are incorporated herein by reference in their entirety.

FIELD

This disclosure relates generally to combustion devices. More specifically, the disclosure relates to a system and method for reducing emissions in a boiler.

BACKGROUND

Coal is typically used as a fuel in boilers. Before the coal is introduced into a combustion area of a boiler and burned, it is typically pulverized. After pulverization, the coal is typically conveyed through one or more conduits to the combustion area of the boiler. The pulverized coal is ignited and burned in the combustion area. Gases generated during combustion are conveyed through one or more flues in fluid communication with the combustion area of the boiler. These gases are typically referred to as flue gases and typically include pollutants such as nitrogen oxides ($NO_x$) and sulfur oxides ($SO_x$).

Efforts have been made to remove pollutants from flue gases generated by coal-fired boilers, such as $NO_x$ and $SO_x$. Existing solutions to reduce $NO_x$ emissions in coal-fired power plants include in-furnace technology such as low $NO_x$ burner/overfire air (OFA) systems and gas reburn systems. Additionally, post-combustion technology such as selective noncatalytic reduction (SNCR) or selective catalytic reduction (SCR) are used to reduce $NO_x$ from flue gases. These solutions are commercially available, but the capital and operating costs for such solutions are high.

SUMMARY

According to aspects illustrated herein, there is provided a system for reducing emissions from a boiler. The boiler generally has a combustion area. The system includes a fuel pipe and a conduit. A bore extends through the conduit and is in fluid communication with the fuel pipe and the combustion area of the boiler. A pre-ignition source is positioned in the conduit. The pre-ignition source operates to pre-ignite at least a portion of the fuel flowing through the conduit.

According to other aspects illustrated herein, there is provided a method for reducing emissions from a boiler. The method includes the steps of providing a boiler having a combustion area. A fuel pipe is provided for delivering fuel to the boiler. The method further includes the step of providing a conduit in fluid communication with the fuel pipe and the combustion area of the boiler. The method further includes providing a pre-ignition source that is positioned inside the conduit. Fuel is delivered from the fuel pipe to the combustion area of the boiler through the conduit. At least a portion of the fuel flowing through the conduit is ignited by the pre-ignition source.

DETAILED DESCRIPTION

Figure 1:
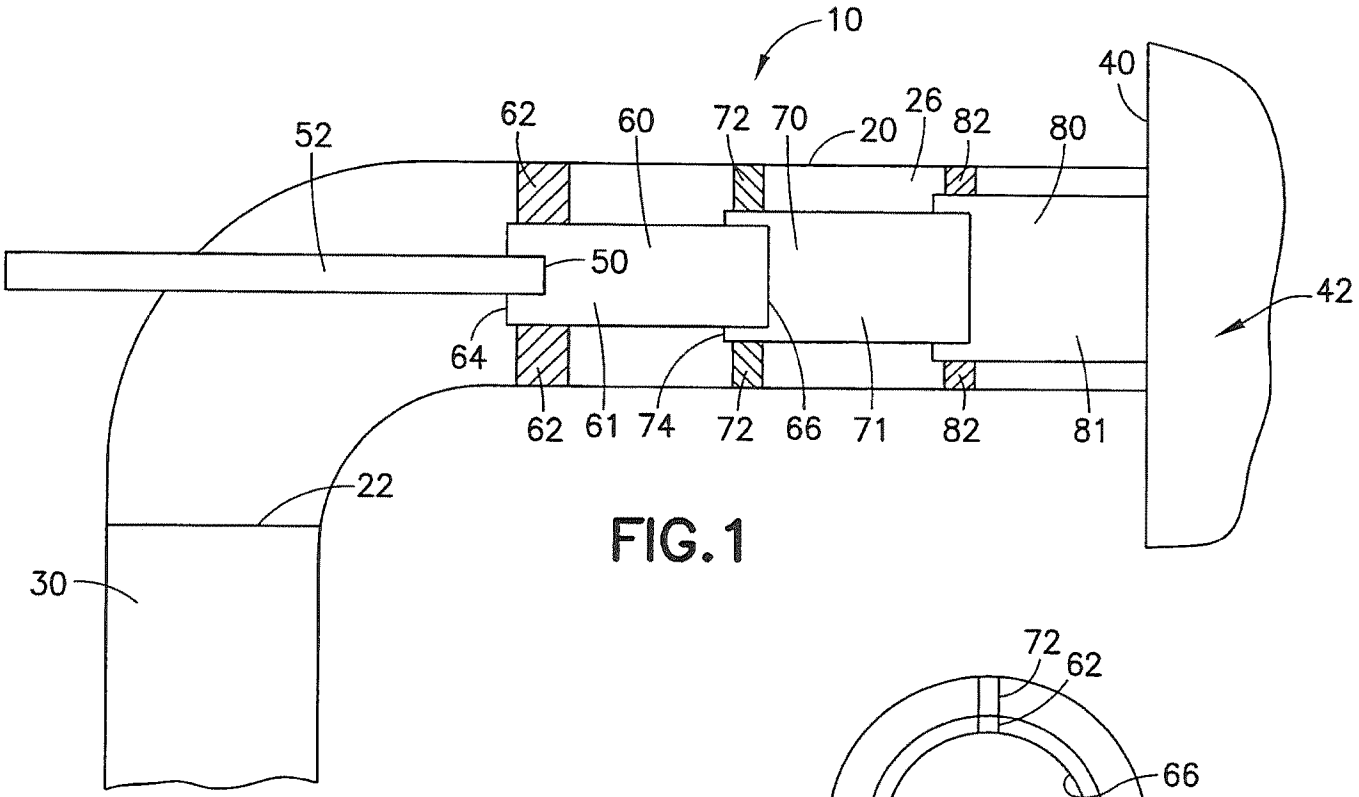
FIG. 1 is a cross-sectional view of a portion of a pre-ignition system.

In reference to FIG. 1, a pre-ignition system generally designated by the reference number 10 includes a conduit 20 defining a bore 26 extending there through. A fuel pipe 30 for delivering fuel is in fluid communication with the conduit 20. The pre-ignition system 10 further includes a boiler 40 having a combustion area 42 in fluid communication with the conduit 20. A pre-ignition source 50 is positioned in the conduit 20. During operation, a gas, such as air, conveys fuel from the fuel pipe 30, through conduit 20, and into the combustion area 42. The pre-ignition source 50 ignites at least a portion of the fuel as it passes through the bore 26 defined by the conduit 20. In the embodiment shown, the fuel comprises pulverized coal. It should be understood, however, that the disclosure is not limited in this regard and that different types of fuel, such as, but not limited to, other carbonaceous fuel and/or natural gas, may also be used. In this disclosure, the term pre-ignited refers to the fact that the fuel is ignited in the bore 26 of the conduit 20 before it is delivered to the combustion area 42 of the boiler 40.

Still referring to FIG. 1, the conduit 20 is shown as having an elbow shape. It should be understood, however, that the present disclosure is not limited in this regard and that many different conduit shapes and configurations may be used with the disclosed system. For example, the conduit may be substantially straight, or, for example, the conduit may have a curved shape.

The fuel pipe 30 is coupled to a first end 22 of the conduit 20 so that an inside area of the fuel pipe 30 is in fluid communication with the bore 26 defined by the conduit. Typically, coal is pulverized in one or more pulverizers and then conveyed through the fuel pipe 30 by a gas. Typically, the conveyance gas can be air conveyed through the system 10 by one or more pumps. It should be understood, however, that the disclosure is not limited in this regard and that many different conveyance gases and mixtures thereof, may be employed with the disclosed system, such as, but not limited to oxygen, carbon dioxide, and/or recycled flue gas. A second end 24 of the conduit 20 is coupled to the boiler 40 so that the bore 26 defined by the conduit 20 is in fluid communication with the combustion area 42 defined by the boiler.

The pre-ignition source 50 is disposed in the bore 26 defined by the conduit 20. The pre-ignition source 50 is coupled to an ignition support 52 that extends into the bore 26. As shown in FIG. 1, the pre-ignition source 50 is proximate to a distal end of the pre-ignition support 52. The pre-ignition support 52 extends into the bore 26 of the conduit. The pre-ignition source 50 may be any device capable of pre-igniting a fuel being delivered through the bore 26. For example, the pre-ignition source 50 may include, but is not limited to, low capacity oil igniters, low capacity natural gas igniters, and plasma igniters. However, the present disclosure is not limited in this regard and any device capable of pre-igniting the fuel being delivered through the bore 26 of the conduit 20 may be used. While the pre-ignition source has been shown and described as being proximate to a distal end of an ignition support 52 extending from an area outside the bore 26 to an area inside the bore 26, the disclosure is not limited in this regard, and many different configurations can be used. For example, an electric pre-ignition source and support may be disposed entirely within the bore, the ignition source being actuated by a wireless control.

The system 10 further includes a plurality of pre-ignition conduits 60, 70, 80 disposed in the conduit 20. Each pre-ignition conduit 60, 70, 80 defines a bore 61, 71, 81 extending there through. The pre-ignition conduits 60, 70, 80 are disposed in the bore 26 defined by the conduit 20. Each pre-ignition conduit 60, 70, 80 is secured in position in the bore 26 by respective support elements 62, 72, 82.

The pre-ignition source 50 is disposed in the bore 61 of the first pre-ignition conduit 60 proximate to a leading edge 64 of the first pre-ignition conduit 60. During operation pulverized coal is conveyed through the conduit 20. A least a portion of the pulverized coal is entrained in the bore 61 of the first pre-ignition conduit 60, while at least a portion of the pulverized coal flows through the conduit 20 outside of the bore 61 of the first pre-ignition conduit 60.

A trailing edge 66 of the first pre-ignition conduit 60 is disposed inside the bore 71 of the second pre-ignition conduit 70. A leading edge 74 of the second pre-ignition conduit 70 has a larger area opening to the bore 71 of the second pre-ignition conduit 70 as compared to the outside dimension of the first pre-ignition conduit 60 at its trailing edge 66. During operation at least a portion of the pulverized coal flowing through the conduit 20 that was not entrained in the bore 61 of the first pre-ignition conduit 60 is entrained in the bore 71 of the second pre-ignition conduit 70, while at least a portion of the pulverized coal flows through the conduit 20 outside of the bore 71 of the second pre-ignition conduit 70.

Similarly, a trailing edge 76 of the second pre-ignition conduit 70 is disposed inside the bore 81 of the third pre-ignition conduit 80. A leading edge 84 of the third pre-ignition conduit 80 has a larger area opening to the bore 81 of the third pre-ignition conduit 80 as compared to the outside dimension of the second pre-ignition conduit 70 at its trailing edge 76. During operation at least a portion of the pulverized coal flowing through the conduit 20 that was not entrained in either the bore 61 of the first pre-ignition conduit 60 or the bore 71 of the second pre-ignition conduit 70 is entrained in the bore 81 of the third pre-ignition conduit 80, while at least a portion of the pulverized coal flowing through the conduit 20 flows outside of the bore 81 of the third pre-ignition conduit 80.

In the embodiment illustrated in FIG. 1, the system 10 is shown and described as having three pre-ignition conduits 60, 70, 80. However, the present disclosure is not limited in this regard. For example, the disclosed system may have a conduit with a bore in that there are no pre-ignition conduits disposed therein. The number of pre-ignition conduits may vary from zero to greater than ten. Similarly, the shape and configuration of the one or more pre-ignition conduits may vary.

During operation of the system 10, pulverized coal is conveyed from the fuel pipe 30, through the conduit 20, and into the combustion area 42 of the boiler 40. At least a portion of the pulverized coal is pre-ignited by the pre-ignition source 80 as it flows past the pre-ignition source 50 and before it exits the bore 26. In this way, the system 10 provides pre-ignition of a portion of a fuel supply being supplied to the combustion area 42 of the boiler 42. The portion of the fuel supply that has been pre-ignited by the pre-ignition source 50 subsequently ignites an annular stream of pulverized coal inside the bore 26 of the conduit 20.

The pre-ignition source 50 and subsequent pre-ignition of surrounding fuel in the bore 26 of the conduit 20 pre-ignites between 10% and 50% of the total flow of pulverized coal to the combustion area 42 of the boiler 40. It should be understood that this range is in reference to the disclosed embodiment in FIG. 1 and is not intended to limit the present disclosure, as the system of the present disclosure can pre-ignite less than 10% or greater than 50% of the total flow of pulverized coal flowing through the conduit. The pulverized coal is ignited under substoichiometric conditions. In the embodiment shown, the ratio of air to pulverized coal is between 0.1 and 0.4. It should be understood that the present disclosure is not limited in this regard, and that a broad range of air to fuel ratios may be employed. It has been found that pre-ignition of the coal under fuel-rich conditions, such as those described above, acts to release fuel volatiles, including nitrogen, under fuel-rich conditions. The pre-ignition source 50, and resultant pre-ignition of at least a portion of the fuel supply inside the bore 26 of the conduit 20, can operate throughout the load range of the boiler. For example, the pre-ignition source may be used to pre-ignite fuel during start-up of the boiler. In addition, the pre-ignition source may be used to pre-ignite fuel during regular operation of the boiler. Regular operation of the boiler includes continuous operation of the boiler after the boiler has been brought online. It has been found that continuous pre-ignition of fuel during regular operation of the boiler enhances reduction of NO in the emissions of the boiler.

Figure 2:
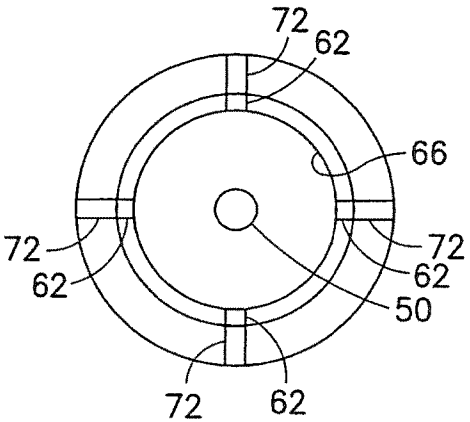
FIG. 2 is a cross-sectional view of a portion of the system shown in FIG. 1.
Figure 3:
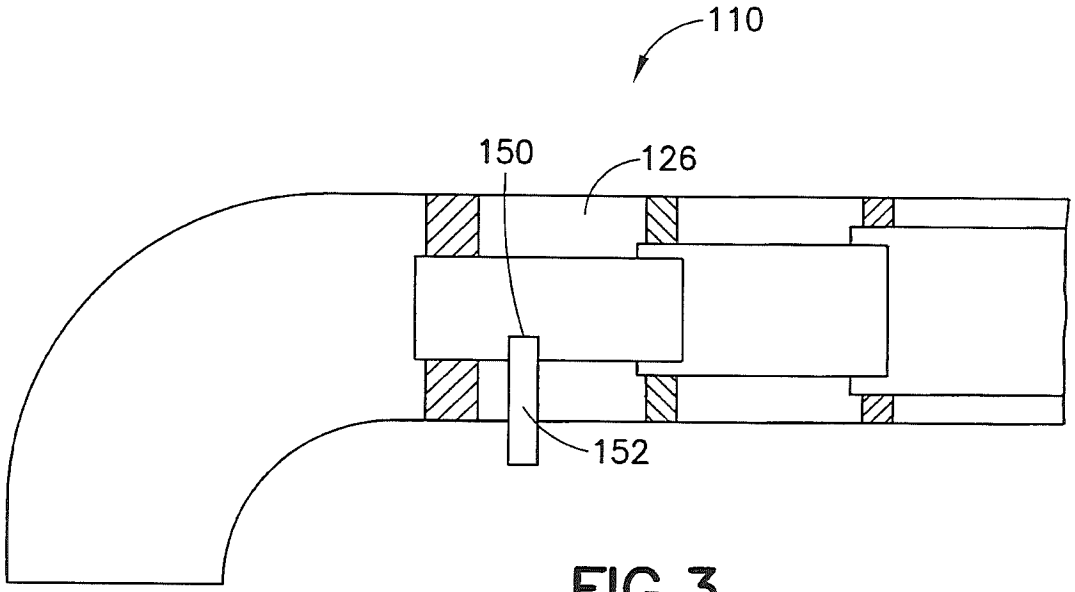
FIG. 3 is a cross-sectional view of a portion of a pre-ignition system.

In reference to FIG. 3, a second embodiment of a system 110 in accordance with the present disclosure is shown. This system 110 is similar to the embodiment disclosed in FIG. 1. In the system 110 shown in FIG. 2, the pre-ignition support 52 extends from an area outside of a bore 126 of the conduit 120 upwardly into the bore 126 of the conduit so that that pre-ignition source 150 is in a central radial region of the bore 126. It should be understood that the present disclosure is not limited in this regard, and that many different configurations of pre-ignition sources can be used to achieve pre-ignition.

Figure 4:
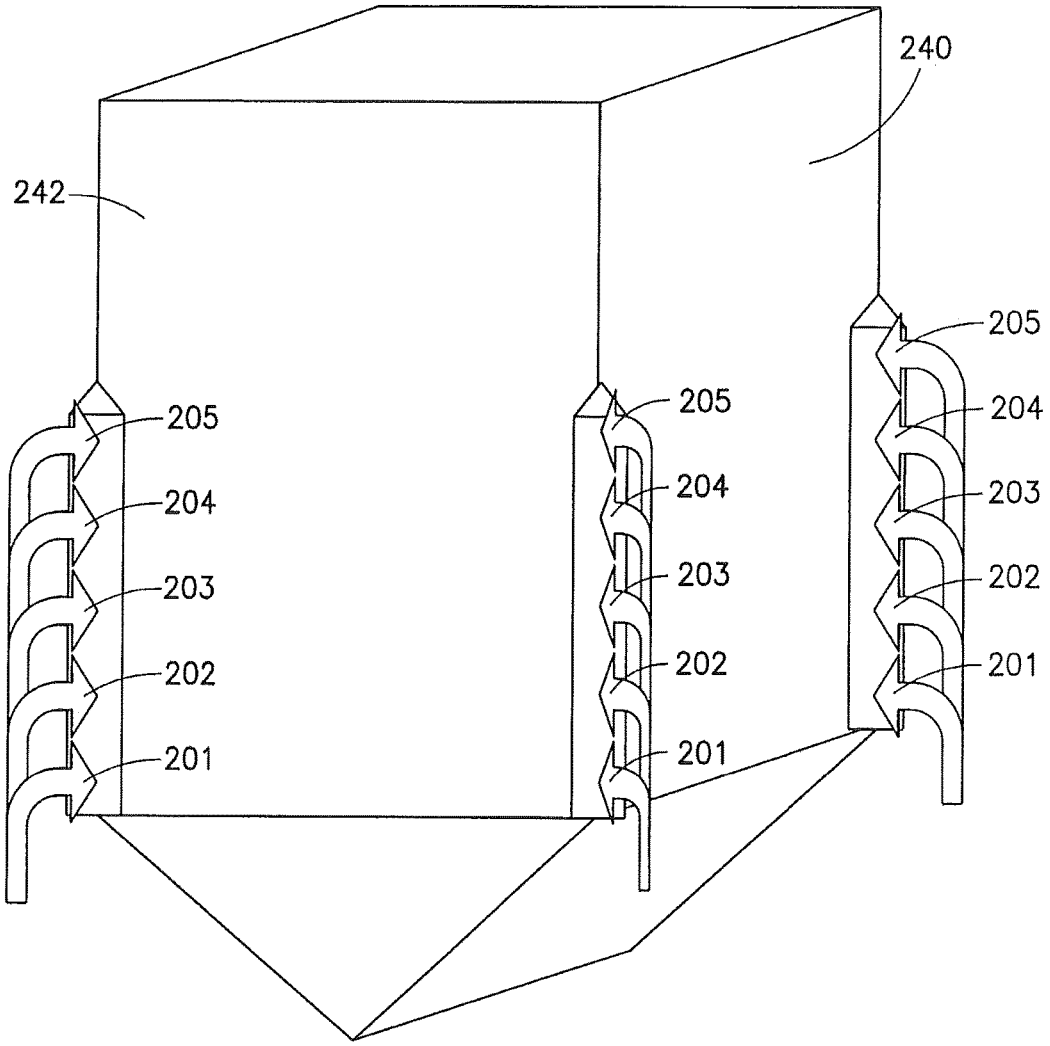
FIG. 4 is a perspective view of a portion of a boiler.

In reference to FIG. 4, a system 210 is shown in which a plurality of conduits 220 supply fuel to a combustion area 242 of a boiler 240. In the system 110 there are five coal supply elevations 201, 202, 203, 204, 205. Each elevation includes four conduits (only three shown in FIG. 3) in accordance with the present disclosure and as described above, wherein each conduit is capable of supplying fuel to the combustion area 242 of the boiler 240 and pre-igniting at least a of portion of the fuel before it exits the bore and enters the combustion area 242 of the boiler 240. During operation of the boiler 240, the conduits on the first and second elevation 201, 202 operate to pre-ignite at least a portion of pulverized coal flowing through the conduits, while the conduits on the third, fourth, and fifth elevations do not operate to pre-ignite any portion of pulverized coal flowing through those conduits. It should be understood that the present disclosure is not limited in this regard and that many different configurations of conduits, fuel pipes, and/or elevations may be used with the disclosed system. For example, the number of conduits on each level may vary. There may be a different number of elevations, and the elevations operating as pre-ignition elevations may vary.

Although the present disclosure has been disclosed and described with reference to certain embodiments thereof, it should be noted that other variations and modifications may be made, and it is intended that the following claims cover the variations and modifications within the true scope of the disclosure.

What is claimed is:

1. A system for reducing emissions in a boiler having a combustion area, comprising:

a plurality of coal supply elevations in the combustion area, each fuel supply elevation including a conduit having a bore extending there through, the bore being in fluid communication with a fuel pipe and the combustion area of the boiler; and a pre-ignition source positioned in the conduit disposed at the lowest fuel supply elevation and operable to pre-ignite at least a portion of the fuel flowing through conduit prior to the fuel entering the combustion area;

wherein the conduit disposed above the lowest fuel supply elevation does not include a pre-ignition source to pre-ignite any portion of the fuel flowing there through.

2. The system of claim 1, wherein the fuel comprises carbonaceous fuel.

3. The system of claim 2, wherein the fuel comprises pulverized coal.

4. The system of claim 3, wherein the pre-ignition source continually pre-ignites at least a portion of the fuel flowing through the conduit disposed at the lowest fuel supply elevation during regular operation of the boiler.

5. The system of claim 4, wherein the ignition source operates throughout a boiler load range.

6. The system of claim 3, wherein between 10% and 50% of the fuel flowing through the conduit disposed at the lowest fuel supply elevation is pre-ignited in the conduit.

7. The system of claim 3, wherein at least a portion of the fuel flowing through the conduit disposed at the lowest fuel supply elevation is pre-ignited under substoichiometric conditions.

8. The system of claim 7, wherein ratio of air to fuel is sufficiently fuel rich for release of fuel volatiles.

9. The system of claim 1, further comprising:

a first pre-ignition conduit defining a first bore extending there through, the first pre-ignition conduit being disposed in the bore of the conduit disposed at the lowest fuel supply elevation, the pre-ignition source (50) being positioned in the bore of the first pre-ignition conduit; and wherein at least a portion of the fuel flowing through the conduit disposed at the lowest fuel supply elevation is entrained through the bore of the first pre-ignition conduit.

10. The system of claim 9, further comprising:

a second pre-ignition conduit defining a second bore extending there through, the second pre-ignition conduit being disposed in the bore of the conduit disposed at the lowest fuel supply elevation, wherein at least a portion of the fuel flowing through the conduit disposed at the lowest fuel supply elevation is entrained through the bore of the second pre-ignition conduit.

11. The system of claim 9, further comprising:

a third pre-ignition conduit defining a third bore extending there through, the third pre-ignition conduit being disposed in the bore of the conduit;

wherein at least a portion of the fuel flowing through the conduit is entrained through the bore of the third pre-ignition conduit.

12. The system of claim 1, wherein respective pre-ignition sources are positioned in respective conduits disposed at the lowest fuel supply elevations and operable to pre-ignite at least a portion of the fuel flowing through the respective conduits prior to the fuel entering the combustion area.

13. The system of claim 1, wherein respective pre-ignition sources are positioned only in respective conduits disposed at the lowest fuel supply elevations and operable to pre-ignite at least a portion of the fuel flowing through the respective conduits prior to the fuel entering the combustion area.

14. The system of claim 1, wherein conduits disposed above conduits having a pre-ignition source do not include a pre-ignition source.

15. A method for reducing emissions in a boiler having a, first fuel elevation, a second fuel elevation, a third fuel elevation, a fourth fuel elevation, and a fifth fuel elevation, each of the first through fifth fuel elevations comprising a respective nozzle operable to deliver a fuel to a combustion area of the boiler, the method comprising:

delivering fuel to the combustion zone of the boiler through the nozzles associated with the first fuel elevation and the second fuel elevation;

pre-igniting at least a portion of the fuel provided to the nozzles associated with the first fuel elevation and the second fuel elevation; prior to delivering the fuel through the nozzles associated with the first fuel elevation and the second fuel elevation;

wherein fuel delivered through the nozzles associated with the first fuel elevation and the second fuel elevation flows through a conduit before it flows through the nozzles associated with the first fuel elevation and the second fuel elevation, and is pre-ignited in the conduit, and wherein respective conduits on the third, fourth, and fifth elevations do not operate to pre-ignite any portion of pulverized coal flowing through those respective conduits.

16. The method of claim 15, wherein the pre-ignition of fuel continues during regular operation of the boiler.

17. The method of claim 16, further comprising:

pre-igniting at least a portion of the fuel provided to the nozzles disposed at the lowest fuel supply elevations prior to delivering the fuel through the nozzle disposed at the lowest fuel supply elevation.

18. The method of claim 15, further comprising:

pre-igniting at least a portion of the fuel provided to the nozzles disposed only at the lowest fuel supply elevations prior to delivering the fuel through the nozzle disposed at the lowest fuel supply elevation.

19. The method of claim 15, further comprising:

pre-igniting at least a portion of the fuel provided to the nozzles disposed below the nozzles wherein no pre-igniting take place.

* * * * *